US012569052B2

(12) United States Patent
Watkins et al.

(10) Patent No.: US 12,569,052 B2
(45) Date of Patent: Mar. 10, 2026

(54) ARTICLE HOLDER

(71) Applicant: WanderFull, Corp, Westport, CT (US)

(72) Inventors: Lisa Raphaeli Watkins, Westport, CT (US); Kathryn Hoffman Hill, Westport, CT (US)

(73) Assignee: WanderFull, Corp, Westport, CT (US)

( * ) Notice: Subject to any disclaimer, the term of this patent is extended or adjusted under 35 U.S.C. 154(b) by 96 days.

(21) Appl. No.: 18/496,503

(22) Filed: Oct. 27, 2023

(65) Prior Publication Data

US 2024/0138548 A1 May 2, 2024

Related U.S. Application Data

(60) Provisional application No. 63/420,457, filed on Oct. 28, 2022.

(51) Int. Cl.
*A45F 5/02* (2006.01)
*A45F 5/00* (2006.01)

(52) U.S. Cl.
CPC ..... *A45F 5/02* (2013.01); *A45F 5/021* (2013.01); *A45F 5/022* (2013.01); *A45F 2005/002* (2013.01); *A45F 2005/006* (2013.01); *A45F 5/1583* (2025.01)

(58) Field of Classification Search
CPC .. A45F 5/02; A45F 5/021; A45F 5/022; A45F 5/1583; A45F 2005/002; A45F 2005/006
See application file for complete search history.

(56) References Cited

U.S. PATENT DOCUMENTS

| | | | | |
|---|---|---|---|---|
| 5,002,401 | A * | 3/1991 | Blackman | A45C 7/0095 190/127 |
| 6,073,796 | A * | 6/2000 | Mogil | B65D 81/3886 220/592.24 |
| 9,265,331 | B1 * | 2/2016 | Hoffman | A45F 5/00 |
| 9,307,854 | B2 | 4/2016 | Myers | |
| 10,518,971 | B2 * | 12/2019 | Butler | B65F 1/002 |
| 11,053,070 | B2 * | 7/2021 | Butler | B65F 1/141 |
| 11,076,666 | B2 * | 8/2021 | Sullivan | A45C 13/008 |
| 2001/0027834 | A1 * | 10/2001 | Southwick | A45F 5/00 150/108 |
| 2006/0040333 | A1 * | 2/2006 | Zocchi | A45C 11/00 435/14 |
| 2007/0051645 | A1 * | 3/2007 | Hassett | A45F 5/022 206/320 |

(Continued)

FOREIGN PATENT DOCUMENTS

WO 2013066206 A1 5/2013

*Primary Examiner* — Khaled Annis
(74) *Attorney, Agent, or Firm* — Nutter McClennen & Fish LLP

(57) ABSTRACT

According to examples, an article holder, such as a beverage container holder, may include an outer case composed of a first clamshell section, a second clamshell section connected to the first clamshell section by a movable joint to enable the outer case to be in a closed position or an opened position, and a connecting mechanism to hold the first clamshell section and the second clamshell section together when the outer case is in the closed position. The article holder may also include a pouch to hold an article attached to an interior surface of the first clamshell section, in which the pouch is movable between a collapsed state and an expanded state.

7 Claims, 3 Drawing Sheets

(56) References Cited

U.S. PATENT DOCUMENTS

| | | | | |
|---|---|---|---|---|
| 2011/0253494 | A1* | 10/2011 | Coventry | A45C 3/06 190/110 |
| 2012/0048849 | A1* | 3/2012 | Crandall | A45C 11/38 220/4.03 |
| 2012/0104058 | A1* | 5/2012 | Hernandez | A45F 5/021 224/660 |
| 2014/0069063 | A1* | 3/2014 | Edmonds | A45C 11/24 53/473 |
| 2015/0068933 | A1* | 3/2015 | So | A45C 11/38 150/112 |
| 2015/0265083 | A1* | 9/2015 | Myers | B65D 25/54 220/737 |
| 2016/0121642 | A1* | 5/2016 | Herbst | B42F 13/26 220/4.23 |
| 2017/0049201 | A1* | 2/2017 | Moreau | A45C 13/103 |
| 2018/0035773 | A1* | 2/2018 | Wiegand-Hansen | A45C 3/001 |
| 2020/0237082 | A1* | 7/2020 | Willows | A45F 5/10 |
| 2021/0244219 | A1 | 8/2021 | Richard | |
| 2022/0022615 | A1* | 1/2022 | Cokeley | A45C 11/00 |
| 2022/0322797 | A1* | 10/2022 | Aquino | A45C 5/06 |
| 2024/0032662 | A1* | 2/2024 | Milligan | A45F 3/005 |
| 2024/0138548 | A1* | 5/2024 | Watkins | A45F 5/02 |
| 2024/0237792 | A1* | 7/2024 | Chao | A45C 11/00 |

* cited by examiner

ARTICLE HOLDER

BACKGROUND

Hydration is important, especially when a person is walking, running, traveling, sightseeing, attending festivals and concerts, or engaging in recreational activities. However, it may be cumbersome and/or distracting to hold a beverage container in one's hands during these activities. Most importantly, using one's phone to communicate with others or for entertainment purposes requires both hands and thus leaves no option of carrying a beverage on-the-go. Beverage container holders that are mounted on mounting straps, such as belts, have been developed to enable users to keep their beverages with them without having to constantly hold their beverages. The beverage container holders are typically bulky regardless of whether the holders are holding a beverage container or not. For style purposes, many users want the option to store the beverage holder away, or remove it altogether from the belt, beltbag or strap that is holding it versus having the beverage holder act as a permanent fixture.

BRIEF DESCRIPTION OF DRAWINGS

Features of the present disclosure are illustrated by way of example and not limited in the following figures, in which like numerals indicate like elements. One skilled in the art will readily recognize from the following that alternative examples of the structures and methods illustrated in the figures can be employed without departing from the principles described herein.

DETAILED DESCRIPTION

For simplicity and illustrative purposes, the present application is described by referring mainly to examples thereof. In the following description, numerous specific details are set forth in order to provide a thorough understanding of the present application. It will be readily apparent, however, that the present application may be practiced without limitation to these specific details. In other instances, some methods and structures readily understood by one of ordinary skill in the art have not been described in detail so as not to unnecessarily obscure the present application. As used herein, the terms "a" and "an" are intended to denote at least one of a particular element, the term "includes" means includes but not limited to, the term "including" means including but not limited to, and the term "based on" means based at least in part on.

Typical beverage container holders that are supported on straps, such as belts are normally sized to hold the beverage containers. In this regard, the beverage container holders often have the same size regardless of whether the beverage container holder is holding a beverage container or not. As a result, typical beverage container holders are often bulky and may interfere with users' ability to properly perform various tasks, such as walking or performing another type of exercise.

Disclosed herein are article holders (including beverage container holders) that each includes a pouch (or collapsible receptacle) for holding an article, in which the pouch may be collapsed when not in use. In addition, the articles holders disclosed herein each includes an outer case that may be movable between a closed position and an opened position, in which the pouch may be housed in a collapsed state within the outer case when the outer case is in the closed position. The outer case may thus protect the pouch when the outer case is in the closed position.

As a result, the article holder disclosed herein may have a relatively small size when the article holder is not being used to hold an article. Additionally, the article holder may be supported on a supporting strap, such as a belt, both when the article holder is being used to hold an article and the article holder is not being used to hold an article.

Figure 1:
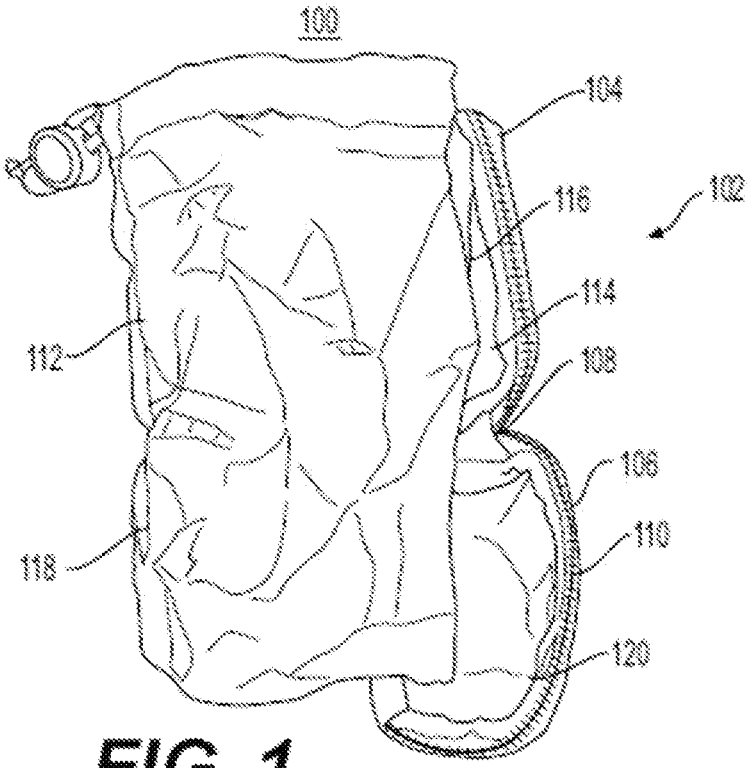
FIG. 1 shows a side perspective view of an article holder, in accordance with an embodiment of the present disclosure.

With reference first to FIG. 1, there is shown a side perspective view of an article holder 100, in accordance with an embodiment of the present disclosure. It should be understood that the article holder 100 depicted in FIG. 1 may include additional features and that some of the features described therein may be removed and/or modified without departing from the scope of the article holder 100.

As shown in FIG. 1, the article holder 100, which is also referenced herein as a beverage container holder 100, may include an outer case 102. The outer case 102 may include a first clamshell section 104 and a second clamshell section 106. The second clamshell section 106 is depicted as being connected to the first clamshell section 104 by a movable joint 108. The article holder 100 is also depicted as including a pouch 112, which is also referenced herein as a receptacle 112, which is to hold an article. The article may include any suitable type of article that may fit within the pouch. Non-limiting examples of the article may include a beverage container (such as a water bottle, beer bottle, beverage can, an insulated bottle, etc.), a cellular phone, keys, a wallet, an umbrella, and a flashlight.

In some examples, an upper portion of the pouch 112 may extend above an upper portion of the first clamshell section 104 and a bottom portion of the pouch 112 may extend above a lower portion of the second clamshell section 106. In other examples, the upper portion of the pouch 112 may be at the same height as the upper portion of the first clamshell section 104 and the bottom portion of the pouch 112 may be at the same height as the lower portion of the second clamshell section 106.

As also shown in FIG. 1, the pouch 112 is attached to an interior surface 114 of the first clamshell section 104. Particularly, a portion 116 of the pouch 112 is attached to the interior surface 114 of the first clamshell section 104. The portion 116 of the pouch 112 may be attached to the interior surface 114 through any suitable attachment mechanism. Examples of suitable attachment mechanisms include threads, adhesives, mechanical fasteners, and/or the like. In some examples, the portion 116 of the pouch 112 may removably be attached to the interior surface of the first clamshell section 104. For instance, the portion 116 may be attached through use of hook and loop fasteners, mating removable fasteners, e.g., buttons, and/or the like.

Figure 2:
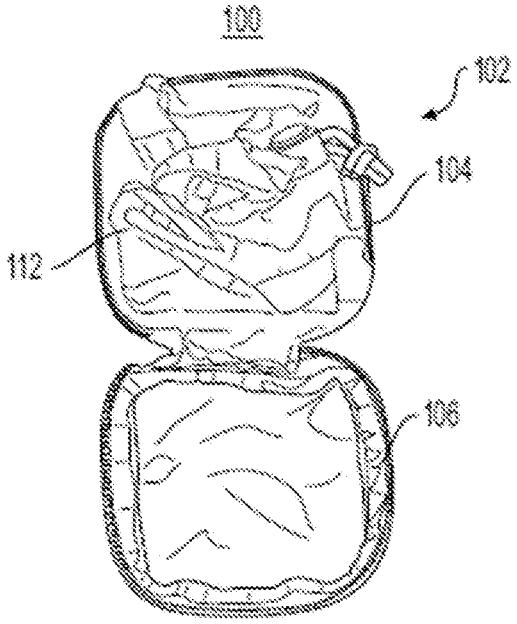
FIG. 2 shows a front view of the article holder depicted in FIG. 1 when the outer case is in the opened position, in accordance with an embodiment of the present disclosure.

As shown, a remaining portion 118 of the pouch 112 may not be attached to either the first clamshell section 104 or the second clamshell section 106. In this regard, the pouch 112 may be moved from the expanded state as shown in FIG. 1 to a collapsed state as shown in FIG. 2. FIG. 2 shows a front view of the article holder 100 when the outer case 102 is in the opened position, in accordance with an embodiment of the present disclosure. In some examples, a first fastener element (not shown) may be positioned on an interior surface 114 of the first clamshell section 104 or an interior surface 120 of the second clamshell section 106. In addition, a second fastener element (not shown) may be positioned along the pouch 112 to connect to the first fastener element when the pouch 112 is in the expanded state. By connecting the second fastener element to the first fastener element, an article held within the pouch 112 may be better supported.

As shown in FIG. 2, the pouch 112 may be sized such that the pouch 112 may fit within the first clamshell section 104 when the pouch 112 is in the collapsed state. Particularly, a user may fold, bunch, or otherwise collapse the pouch 112 from the expanded state shown in FIG. 1 to the collapsed state as shown in FIG. 2 when the article holder 100 is to be in a storage state. Likewise, a user may unfold or otherwise expand the pouch 112 from the collapsed state as shown in FIG. 2 to the expanded state as shown in FIG. 1 when the article holder 100 is to be used to hold an article.

Figure 3:
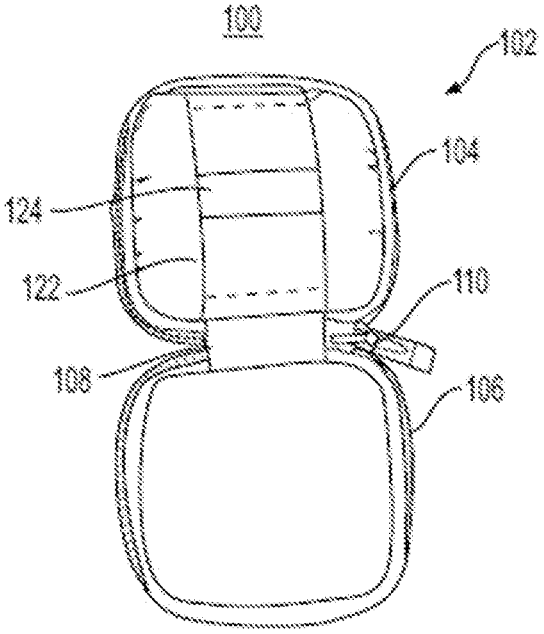
FIG. 3 shows a rear view of the article holder depicted in FIG. 1 when the outer case is in the opened position, in accordance with an embodiment of the present disclosure.

Turning now to FIG. 3, there is shown a rear view of the article holder 100 when the outer case 102 is in the opened position, in accordance with an embodiment of the present disclosure. As shown in FIG. 3, the first clamshell section 104 and the second clamshell section 106 may be connected to each other by a movable joint 108. The movable joint 108 may be a section of fabric that may be sewn to the first clamshell section 104 and the second clamshell section 106. In other examples, the movable joint 108 may be a hinge formed of a relatively more rigid material, such as plastic, nylon, metal, and/or the like.

As shown in FIG. 3, the connecting mechanism 110 may be a zipper mechanism that may bring and hold the outer edges of the first clamshell section 104 and the second clamshell section 106 together. In other examples, the connecting mechanism 110 may be another type of mechanism that may hold the first clamshell section 104 and the second clamshell section 106 in a closed state. For instance, the connecting mechanism 110 may be a hook and loop fastener, a strap with a button attachment, and/or the like.

As also shown in FIG. 3, the article holder 100 may include an attachment element 122 that enables the article holder 100 to be mounted or supported on a supporting strap, such as a belt or other type of strap. In this regard, the attachment element 122 may be attached to an exterior surface of the first clamshell section 104 at top and bottom ends of the attachment element 122 to form an opening 124 between a portion of the attachment element 122 and the exterior surface of the first clamshell section 104.

According to examples, the outer case 102, the pouch 112, and the attachment element 122 may be formed of the same or differing materials. Examples of suitable materials may include cotton, cotton blends, nylon, nylon blends, polyester, polyester blends, faux fur, faux fur blends, faux sheepskin, fur, sheepskin, and/or the like. In some examples, the pouch 112 may be formed of a thermally insulating material, such as polyurethane, or the like.

In some examples, the article holder 100 may include a second pouch (not shown) attached to the first clamshell section 104. The second pouch may be positioned adjacent to the pouch 112 and may have similar features to the pouch 112. For instance, the second pouch may be movable between a collapsed state and an expanded state. In these examples, the outer case 102 may have a wider shape than as shown in FIGS. 1-3, e.g., about double the size of the outer case 102 shown in FIGS. 1-3.

Figure 4:
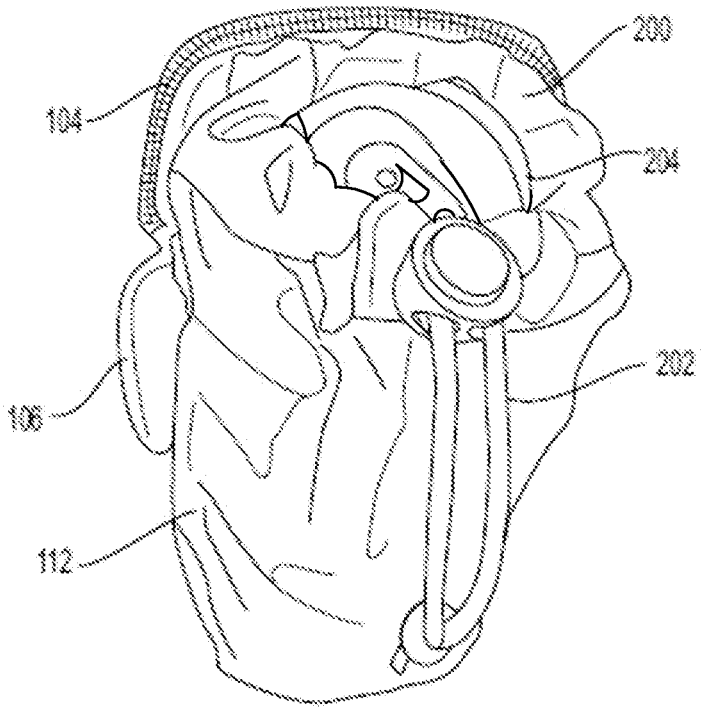
FIG. 4 shows a front perspective view of the article holder depicted in FIG. 1, in accordance with an embodiment of the present disclosure.

Turning now to FIG. 4, there is shown a front perspective view of the article holder 100 depicted in FIG. 1, in accordance with an embodiment of the present disclosure. As shown, the pouch 112 may include an opening 200 at one end of the pouch 112 through which an article 204 may be inserted. The article 204 in FIG. 4 is a beverage container, and in particular a can. Only a top portion of the article 204 is shown through the opening 200. The pouch 112 may also include a mechanism 202 to reduce the size of the opening 200. In FIG. 4, the mechanism 202 is a drawstring that may be tightened to hold the article 204 within the pouch 112. In other examples, the mechanism 202 may be another type of suitable mechanism, such as a hook and loop fastener, a button, a zipper, or the like.

Figure 5:
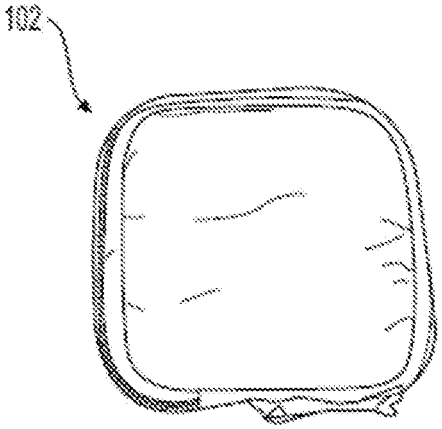
FIGS. 5 and 6, respectively, show a front view and a rear view of the article holder depicted in FIG. 1, in accordance with an embodiment of the present disclosure.
Figure 6:
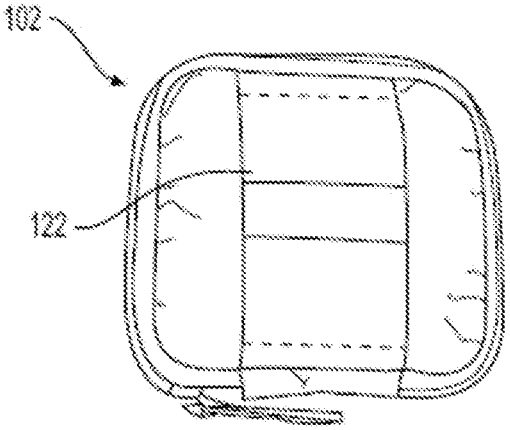

Turning now to FIGS. 5 and 6, there are respectively shown a front view and a rear view of the article holder 100 depicted in FIG. 1, in accordance with an embodiment of the present disclosure.

Figure 7:
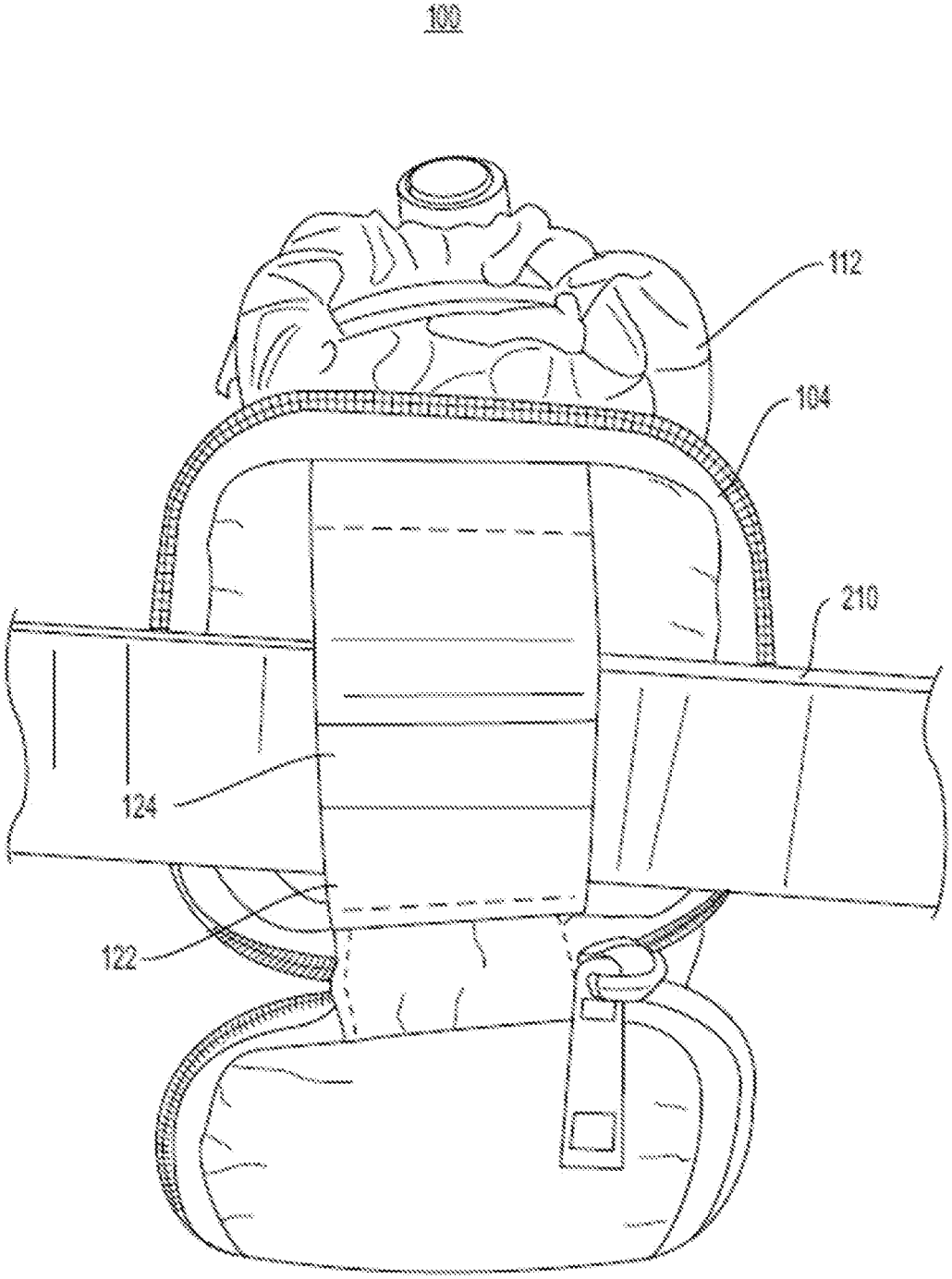
FIG. 7 shows a rear perspective view of the article holder depicted in FIG. 1, in accordance with an embodiment of the present disclosure.

Turning now to FIG. 7, there is shown a rear perspective view of the article holder 100 depicted in FIG. 1, in accordance with an embodiment of the present disclosure. As shown, a strap 210, such as a belt, may be inserted into the opening 124 of the attachment element 122. In this regard, a user of the article holder 100 may mount or otherwise hold the article holder 100 on the user's belt when the article holder 100 is in either the closed position or the opened position. In addition, the article holder 100 may be maintained in an upright position when the article holder 100 is in either of the opened or closed positions.

As the article holder 100 may have a relatively compact size when in the closed position, the article holder 100 may be relatively easy to carry around. Additionally, the article holder 100 may enable users to hold articles such as beverage containers when the users are walking or in motion. According to examples, the outer case 102 may have dimensions that are between about 3.25 inches and about 9 inches. According to examples, the pouch 112 may have dimensions that are about 7×3 inches and about 11×7 inches. Additionally, in examples in which the article holder 100 includes two pouches 112, the outer case 102 may be about 8×4 inches, and the two side by side pouches may be between about 7×3 inches and about 11×7 inches.

In the foregoing description, various inventive examples are described, including devices, systems, methods, and the like. For the purposes of explanation, specific details are set forth in order to provide a thorough understanding of examples of the disclosure. However, it will be apparent that various examples may be practiced without these specific details. For example, devices, systems, structures, assemblies, methods, and other components may be shown as components in block diagram form in order not to obscure the examples in unnecessary detail. In other instances, well-known devices, processes, systems, structures, and techniques may be shown without necessary detail in order to avoid obscuring the examples.

The figures and description are not intended to be restrictive. The terms and expressions that have been employed in this disclosure are used as terms of description and not of limitation, and there is no intention in the use of such terms and expressions of excluding any equivalents of the features shown and described or portions thereof. The word "example" is used herein to mean "serving as an example, instance, or illustration." Any embodiment or design described herein as "example' is not necessarily to be construed as preferred or advantageous over other embodiments or designs.

The invention claimed is:

1. An article holder comprising:

an outer case composed of:

a first clamshell section;

a second clamshell section connected to the first clamshell section by a movable joint to enable the outer case to be in a closed position or an opened position; and a connecting mechanism to hold the first clamshell section and the second clamshell section together when the outer case is in the closed position; and a pouch to hold an article attached to an interior surface of the first clamshell section, wherein the pouch is movable between a collapsed state and an expanded state, and wherein the pouch is removably attached to the interior surface of the first clamshell section.

2. An article holder comprising:

an outer case composed of:

a first clamshell section;

a second clamshell section connected to the first clamshell section by a movable joint to enable the outer case to be in a closed position or an opened position; and a connecting mechanism to hold the first clamshell section and the second clamshell section together when the outer case is in the closed position;

a pouch to hold an article attached to an interior surface of the first clamshell section, wherein the pouch is movable between a collapsed state and an expanded state;

a first fastener element positioned on an interior surface of one of the first clamshell section and the second clamshell section; and a second fastener element positioned along the pouch to connect to the first fastener element when the pouch is in the expanded state.

3. An article holder comprising:

an outer case including:

a first clamshell section;

a second clamshell section connected to the first clamshell section by a movable joint, wherein the second clamshell section is movable with respect to the first clamshell section to move the outer case between a closed position and an opened position; and a connecting mechanism to hold the first clamshell section and the second clamshell section together when the outer case is in the closed position;

a collapsible receptacle attached to an interior surface of the first clamshell section, wherein the collapsible receptacle is movable between a collapsed state and an expanded state; and an attachment element mounted to an outer surface of the first clamshell section, the attachment element including an opening;

a first fastener element positioned on an interior surface of one of the first clamshell section and the second clamshell section; and a second fastener element positioned on the collapsible receptacle to connect to the first fastener element when the collapsible receptacle is in the expanded state.

4. A beverage container holder comprising:

an outer case including:

a first clamshell section;

a second clamshell section connected to the first clamshell section by a movable joint, wherein the second clamshell section is movable with respect to the first clamshell section to move the outer case between a closed position and an opened position; and a connecting mechanism to hold the first clamshell section and the second clamshell section together when the outer case is in the closed position;

a collapsible receptacle attached to an interior surface of the first clamshell section, wherein the collapsible receptacle is movable between a collapsed state and an expanded state, and wherein the collapsible receptacle has a length that is smaller than a length of the first clamshell section when in the collapsed state and has a length that is greater than the length of the first clamshell section when in the expanded state; and an attachment element mounted to an outer surface of the first clamshell section, the attachment element including an opening.

5. The beverage container holder of claim 4, further comprising:

a first fastener element positioned on an interior surface of the first clamshell section or the second clamshell section; and a second fastener element positioned on the collapsible receptacle to connect to the first fastener element when the collapsible receptacle is in the expanded state.

6. The beverage container holder of claim 5, wherein the collapsible receptacle includes an open top section and a closed bottom section, the collapsible receptacle being attached to the interior surface of the first clamshell section at the open top section.

7. The beverage container holder of claim 4, wherein the attachment element is to hold the beverage container holder in a substantially upright position when the beverage container holder is mounted on a supporting strap and the outer case is in the opened position.

* * * * *